United States Patent [19]

Matsuda

[11] Patent Number: 4,860,721

[45] Date of Patent: Aug. 29, 1989

[54] SUPER ABRASIVE CUTTING SAW

[75] Inventor: Yusaku Matsuda, Osaka, Japan

[73] Assignee: Sanwa Diamond Industrial Co., Ltd., Japan

[21] Appl. No.: 90,220

[22] Filed: Aug. 27, 1987

[30] Foreign Application Priority Data

May 30, 1987 [JP] Japan ..... 62-137213

[51] Int. Cl.[4] ..... B28D 1/04

[52] U.S. Cl. ..... 125/15; 51/207; 76/112; 30/350

[58] Field of Search ..... 125/15; 76/112, DIG. 11, 76/DIG. 12; 30/350, 347; 51/207

[56] References Cited

U.S. PATENT DOCUMENTS

| | | | |
|---|---|---|---|
| 2,811,960 | 11/1957 | Fessel | 125/15 |
| 3,049,843 | 8/1962 | Christensen | 125/15 X |
| 3,162,187 | 12/1964 | Christensen | 125/15 |
| 4,067,311 | 1/1978 | Benetello | 125/15 X |
| 4,267,814 | 5/1981 | Benson et al. | 125/15 |
| 4,291,667 | 9/1981 | Eichenlaub et al. | 125/15 |
| 4,461,268 | 7/1984 | Inoue | 125/15 |
| 4,637,370 | 1/1987 | Ishizuka | 125/15 |
| 4,665,887 | 5/1987 | Shiga | 125/15 |
| 4,705,017 | 11/1987 | Lewis | 125/15 |

*Primary Examiner*—Frederick R. Schmidt
*Assistant Examiner*—Shirish Desai

[57] ABSTRACT

A super abrasive cutting saw includes a cutting saw plate formed with concave sections in spaced relation around its periphery. The concave sections alternate with convex sections. Each successive convex section is bent outward toward the opposite surface of the cutting saw plate from the next convex section. A sinter is bonded to the periphery of the cutting saw blade by heating two bodies of a compressed powder formed of material which includes super abrasives and pressing them on the saw plate to be sintered there. Concave and convex portions of the two bodies are formed fused so that the convexities of each oppose the concavities of the other. The border thus formed is extended in zigzag fashion in the direction of thickness of the cutting saw plate corresponding to concave and convex sections thereof. The concave sections of the periphery of the cutting saw plate are deep enough and the inner rim of the sinter is placed for defining holes through the plate for plate cooling and air turbulence generation.

3 Claims, 3 Drawing Sheets

SUPER ABRASIVE CUTTING SAW

BACKGROUND OF THE INVENTION

1. Field of the Invention

The present invention relates to a super abrasive cutting saw and, more specifically, to a diamond cutting saw or a CBN cutting saw made by sintering a pressed powder including super abrasives such as fine diamond abrasives, cubic boron nitride or the like around the periphery of an orbicular cutting saw plate.

2. Description of the Prior Art

As such a diamond cutting saw, for example, the following cutting saw may be given.

As one example of the diamond cutting saw, a pressed powder formed into a prescribed shape by pressing a powder including fine diamond abrasives is formed in advance, after forming two pressed powders having a same shape, a steel plate to be formed into a cutting saw plate is inserted between the two pressed powders in a mold and sintered. In the case of this diamond cutting saw, a seam between the two pressed powders is flat and its outer surfaces are also formed substantially with a flat sinter.

The other diamond cutting saw is formed as such that a sheet of pressed powder formed into a prescribed shape with the powder including the fine diamond abrasives in advance is sintered, and at the same time the cutting saw plate is sintered by intruding it into the sintered portion formed by sintering the pressed powder with its thermal expansion, and simultaneously the sinter is fused onto the cutting saw plate.

Among the conventional diamond cutting saws, since the first diamond cutting saw, when forming the pressed powder, requires to form the orbicular pressed powder having a flat surface preparatively, which is joined together to form a diamond layer with the two pressed powders by sintering, some portions in a border between the two opposing pressed powders are lacking diamond abrasives.

Therefore, by forming a sheet of pressed powder in advance, another diamond cutting saw capable of removing disadvantages of the former diamond cutting saw was invented. However, since the larger the diameter and higher the temperature the larger the magnitude of intrusion of the cutting saw plate into the sinter with its thermal expansion, the latter diamond cutting saw is unsuitable for manufacturing a relatively smaller cutting saw or when using the powder having a lower sintering temperature. Also, bonding strength between the sintered diamond and the cutting saw plate is relatively weak, so the latter diamond cutting saw is unsuitable as the cutting saw used under a severe condition.

A primary object of the present invention is, therefore, to provide the super abrasive cutting saw, in which the super abrasives present in all portions of the sinter and a good sharpness is maintained continuously without being worn locally and unevenly, the number of molds is relatively smaller and a manufacturing apparatus can be simplified and a manufacturing process can be separated for mass production, while enabling to manufacture comparatively smaller cutting saws as well as to use the powder having a lower sintering temperature.

The present invention relates to the super abrasive cutting saw comprising the cutting saw plate formed with suitably spaced concave portions around its periphery, and the sinter sticked to the periphery of the cutting saw plate by heating the pressed powder formed with the powder including super abrasives and divided into two to sinter as being pressed, the sinter being formed as such that at a seam of the two sheets of pressed powders, concave and convex portions formed thereon are fused to oppose each other, its border is extended in a zigzag fashion in the direction of thickness of the cutting saw plate, and corresponding to the concave and convex portions, its outer surfaces also show a corrugated shape formed by a series of concave and convex portions.

The super abrasives incorporated in the sinter, such as fine diamond abrasives, or the like, are present at all portions of the sinter, thereby preventing local and uneven wear and retaining even sharpness. This is because the sinter is formed from two masses that are joined together to define a border that extends in a zigzag fashion along the peripheral border of the masses and which zigzags in the direction of the thickness of the cutting saw plate.

Besides, according to the present invention, since the super abrasive cutting saw can be manufactured by preparatively forming the pressed powder divided into two with the powder including the super abrasives such as the fine diamond abrasives or the like in advance, the manufacturing process can be separated into a plurality of processes, so that the super abrasive cutting saw such as the diamond cutting saw can be manufactured in a large quantity. Also, since the super abrasive cutting saw in accordance with the present invention can be manufactured by preparatively forming the two pressed powders, the number of molds used at sintering can be comparatively reduced to prevent complication of the manufacturing molds.

Moreover, since the super abrasive cutting saw in accordance with the present invention can be manufactured by preparing two preparatively formed pressed powders and joining them together in the molds while holding the cutting saw plate therebetween for sintering, and simultaneously bonding also to the cutting saw plate, different from the conventional diamond cutting saw fused to the sinter by the thermal expansion of the cutting saw plate, reliance on the thermal expansion coefficient of the cutting saw plate is not required. Thus, it is possible to manufacture the comparatively smaller cutting saws and to use the powders having a lower sintering temperature.

DESCRIPTION OF THE DRAWINGS

FIGS. 1 through 3 are drawings showing a diamond cutting saw of one embodiment of the present invention, wherein FIG. 1 is a perspective view, FIG. 2 is a plan view of its essential portion and FIG. 3 is a vertical sectional view thereof.

These objects and other objects, features, aspects and advantages of the present invention will become more apparent from the following detailed description of the embodiment of the present invention when taken in connection with the accompanying drawings.

DESCRIPTION OF THE PREFERRED EMBODIMENTS

Figure 1:
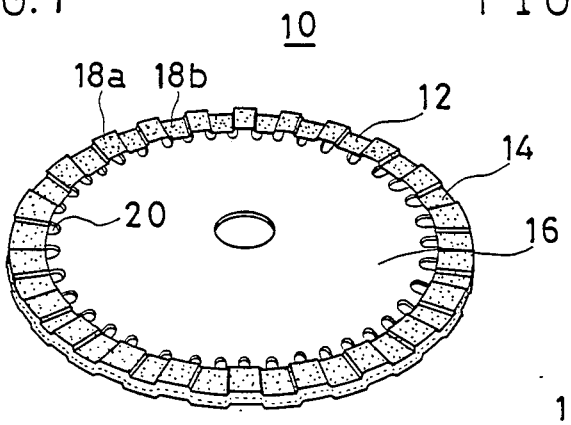
Figure 2:
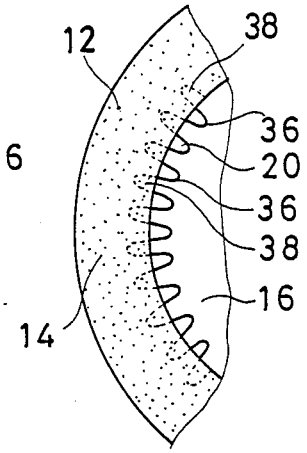
Figure 3:
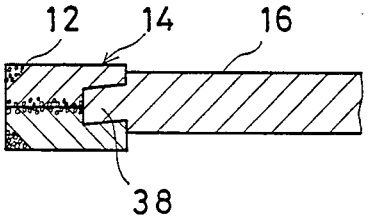
Figure 4:
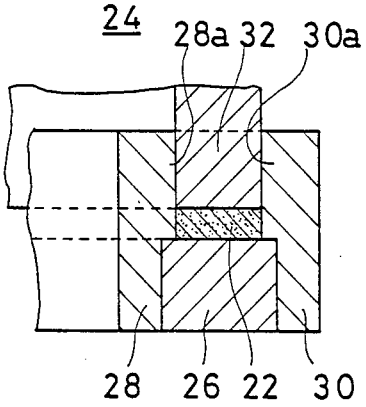
FIG. 4 is an illustrative view showing an example of an apparatus for preparing a pressed powder.

FIG. 1 is a perspective view of a diamond cutting saw of one embodiment of the present invention, FIG. 2 is a plan view of its essential portion and FIG. 3 is a vertical sectional view thereof.

FIG. 4 through FIG. 8 are drawings showing an example of a manufacturing method of the embodiment.

The diamond cutting saw 10 comprises a sinter 14 including super abrasives such as fine diamond abrasives 12 or the like and an orbicular cutting saw plate 16 supporting the sinter 14.

The sinter 14 including the diamond abrasives 12 are formed with concave and convex portions 18*a* and 18*b* on its surfaces in series and formed into a corrugated shape as a whole. Though the concave and convex portions 18*a* and 18*b* are formed radially generally in parallel to the radial direction of the cutting saw plate 16, it may be formed to intersect obliquely radially.

Through the cutting saw plate 16, suitably spaced cooling holes are opened in the vicinity of an inner periphery of the sinter 14.

In the next place, a method for manufacturing the diamond cutting saw 10 will be explained.

A metal powder of 30~50 % copper, 30~50% iron and 5~10% tin including 1~50% fine diamond abrasives 12 of 20~400 meshes by volume is prepared and fed into an apparatus 24 for preparing a pressed powder. (refer to FIG. 4)

The apparatus 24 comprises an inner cylinder 28 and an outer cylinder 30 closely contacting inner and outer walls of an annular mold 26, the outer wall of the inner cylinder 28 and the inner wall of the outer cylinder 30 are projecting in a stepped fashion above the upper surface of the mold 26, thereby forming an enlarged diameter portion 28*a* of the inner cylinder 28 and an elongated portion 30*a* of the outer cylinder 30.

Figure 5:
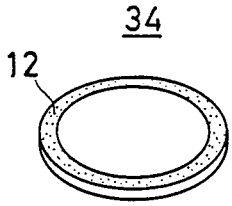
FIG. 5 is an illustrative view showing an example of the pressed powder.
Figure 6:
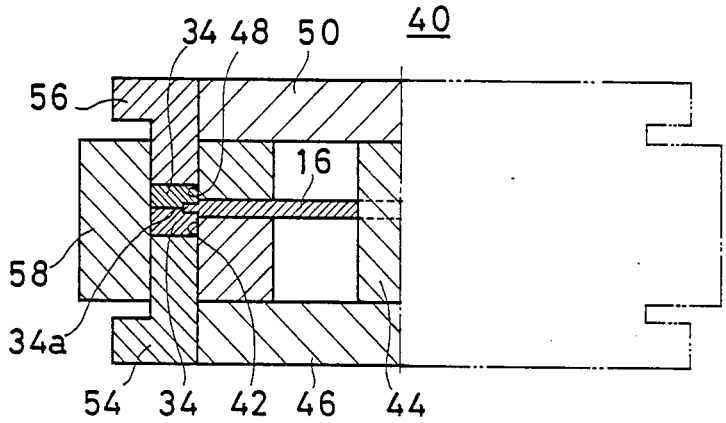
FIG. 6 is a sectional view showing an example of a press sintering apparatus.
Figure 7:
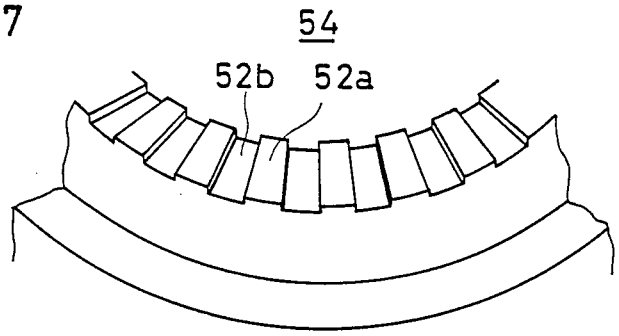
FIG. 7 is a perspective view showing an essential portion of a press mold.

Onto the mold 26, various powders 22 including the fine diamond abrasives weighed by a fixed quantity with a prescribed calculation are fed, an annular press mold 32 is pressed and tightened from upside, and as shown in FIG. 5, a pressed powder 34 hardened into density smaller than about 1 or 30% than that of a sintered alloy to be formed later is formed.

The pressed powder 34 thus formed preparatively has an annular orbicular shape with generally flat surfaces.

As materials of the pressed powder 34, 30–50% nickel, 10–70% cobalt, 5–10% molibdenum and 5–10% tungsten may be further added by one or several kinds besides those aforementioned.

Also, in place of the metal powders mentioned above, for example, synthetic resin powders such as a phenol resin, epoxy resin or polyimide resin or the like may be selectively used.

Besides, the powders forming the pressed powder 34 is uniformly filled and distributed in the apparatus 24, and after being formed preparatively by compressing and binding from the upper and lower sides with a press at the pressure of 1 ton/cm$^2$ or 5 ton/cm$^2$, taken out from the mold and formed.

Meanwhile, in the cutting saw plate 16, a thin disc of a simple substance of iron, copper and titanium or steel or an alloy such as those of copper and beryllium is used, and suitably spaced U-shaped concaves 36 are formed around its periphery. In the gearlike portions of the cutting saw plate 16 formed by its concaves 36, each convex 38 and the each adjacent convex 38 may be slightly curved towards the direction intersecting both surfaces of the cutting saw plate 16 mutually in the opposite direction.

Also, in the embodiment, the thickness of the convex 38 is made slightly thinner than the main body of the cutting saw plate 16. By this construction, a step is formed between the convex 38 and the main body of the cutting saw plate 16, retaining the strength of the cutting saw plate 16 as well as keeping the thickness of the sinter 14 thinner.

Then, next, the pressed powder 34 and the cutting saw plate 16 are fed into a press sintering apparatus 40 prepared separately. (refer to FIG. 6)

The press sintering apparatus 40 has a cylindrical upward faced concave step 42 having the depth generally same as one-half of the height of the pressed powder 34, and includes a mold 46 having a convex shaft 44 in the center and an upper mold 50 having a downward faced concave step 48 symmetrical to the concave step 42 of the mold 46.

By the concave step 42 of the mold aforementioned or the mold 46 and the concave step 48 of the upper mold 50, a space portion for respectively containing the pressed powder 34 is formed. A convex portion 52*a* and a concave portion 52*b* are formed alternately on a press mold 54, while the same convex and concave portions as the press mold 54 are formed on an upper press mold 56, and the press mold 54 and the upper press mold 56 are contacted respectively to the peripheral walls of the mold 46 and the upper mold 50. Moreover, a cylindrical mold 58 is contacted to the peripheral walls of the press mold 54 and the upper press mold 56.

Into the convex shaft 44 projecting in the center of the mold 46, the cutting saw plate 16 is inserted, and the upper mold 50 containing another pressed powder 34 in a prescribed portion of the concave step 48 is mounted so as to hold the pressed powder 34 previously contained in a receiving portion formed by the concave step 42 and the outer periphery of the cutting saw plate 16. The upper press mold 56 is then mounted so as to bring the convex portion 52*a* formed on the upper surface of the press mold 54 and the concave portion formed on the lower surface thereof to face each other.

Then, the pressed powders 34 are pressed from the lower surface of the press mold 54 and the upper surface of the upper press mold 56 by a press unit (not shown) at a prescribed pressure to fuse the pressed powder 34 contained in the press mold 54 and the pressed powder 34 contained in the upper press mold 56 together.

In such pressurized condition, the cutting saw plate 16 and the pressed powders 34 are heated, for example, in an electric furnace in a hydrogen current or a similar atmosphere and sintered into one body.

Thus, the sintered pressed powder 34 is formed by fusing the two pressed powders 34 together as well as the cutting saw plate 16. Thereby, around the periphery of the cutting saw plate 16, the sinter 14 is bonded.

Figure 8:
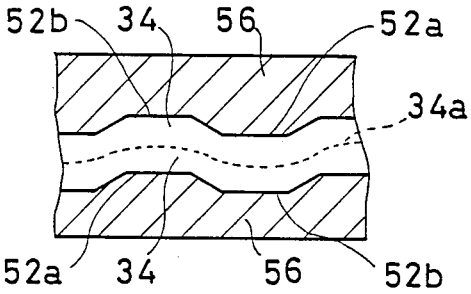
FIG. 8 is an illustrative view showing an essential portion of mold of the press sintering apparatus and the pressed powder, and FIG. 9 are illustrative views showing various examples of concave portions of a cutting saw plate.
Figure 9:
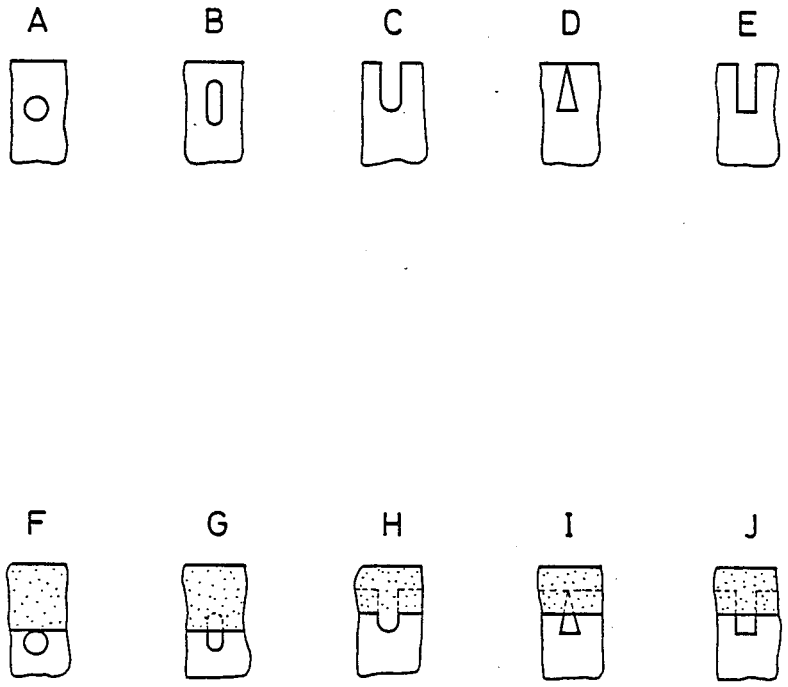

Besides, corresponding to the convex portion 52*a* and concave portion 52*b* formed on the upper surface of the press mold 54 and the convex and concave portions formed on the lower surface of the upper mold 56, as shown in FIG. 8, the outer surfaces of the finished sinter are corrugated, and a seam 34*a* between the two pressed powders 34 is also extended in a zigzag fashion in the direction of thickness of the cutting saw plate 16 along the corrugated shape:

Therefore, when rotating the diamond cutting saw 10 to cut a work to be cut, the seam of the pressed powders 34 is never in a state to contact the work continuously because it is not straight, and the fine diamond abrasives are present at all portions. Thus, the diamond cutting saw does not wear locally and unevenly.

Moreover, by the irregularity formed by the concave 36 and convex 38 of the cutting saw plate 16, a bonding area of the cutting saw plate 16 and the sinter 14 is widen and increased the bonding strength In addition, in the embodiment, since the holes 20 are formed in series near the sinter 14, even in the dry process, for example, used with a motor driven grinder which is different from using water for cooling the sintered portion, air is stirred by the holes 20 so as to radiate a heat generated during cutting into the air. That is to say, a heat is hard to conduct into the core of the cutting saw plate 16 by its cooling effect.

In the meantime, the molds 46 and 50 in the press sintering apparatus 40 are molded by carbon, conductive ceramics, ferrite, tungsten carbide and the like.

In the embodiment of diamond cutting saw, though the holes 20 are formed along the inner periphery of the sinter 14, in place of such holes 20, for example, the shape of concaves 36 formed around the periphery of the cutting saw plate 16 can be naturally suitably changed as shown in FIGS. 9A through 9J.

Meanwhile, in place of the fine diamond abrasives, super abrasives such as cubic boron nitride (CBN) or the like may be selected.

Although the present invention has been described and illustrated in detail, it is clearly understood that the same is by way of illustration and example only and is not to taken by way of limitation, the spirit and scope of the present invention being limited only by the terms of the appended claims.

What is claimed is:

1. A super abrasive rotatable cutting saw comprising a cutting saw plate having an outer periphery, the plate having concave sections extending inwardly from the outer periphery of the plate, the concave sections having a suitably spaced relation around the outer periphery of the cutting saw plate; the spaced concave sections alternating with convex sections extending radially outwardly from the outer periphery of the plate; the plate also having opposite side surfaces;

each of the convex sections of the cutting saw plate around the outer periphery of the plate being bent in a direction toward a respective outside surface of the plate, such that alternate convex sections are bent toward the opposite side surface of the cutting saw plate from the neighboring convex portions; the convex sections of the cutting saw plate are of thinner thickness than the rest of the plate for defining a step between the plate and the convex sections thereof, a continuous, annular, sinter comprised of press-molded powder containing super abrasives, which is divided into two parts and is sintered to the cutting saw plate by heating under pressure; the sinter has a radial thickness from the outer periphery of the cutting saw plate inward over the convex sections toward an inner rim of the sinter; the concave sections being radially deep enough and the inner rim of the sinter being radially so placed that the concave sections of the plate extend inward from the inner rim of the sinter and define holes through the cutting saw plate radially inward of the sinter wherein the holes inward of the sinter reduce thermal conductivity of the plate radially inward from the outer periphery and cause cooling air flow as the cutting saw plate rotates;

each of the two parts of the sinter having a series of alternating convex and concave portions at the respective side surface of the cutting saw plate for each sinter part; the sinter parts are placed so that the convex portions of each part are opposed to the concave portions of the other part; the sinter parts being bonded together with the aid of the convex and concave portions;

the combined sinter parts varying along the direction of the saw plate thickness to define the series of convex and concave portions, and each convex portion of the cutting saw plate which is bent in one direction toward one cutting saw plate surface being within a respective convex portion of the sinter which is convex toward the same one surface of the cutting saw plate.

2. A super abrasive cutting saw in accordance with claim 1, wherein the sinter is hardened orbicularly with a pressed powder including 1–50% by volume of 20–400 meshes fine diamond abrasives.

3. A super abrasive cutting saw in accordance with claim 1, wherein the cutting saw plate is formed by a steel material and formed with the U-shaped concave sections around its periphery to which the pressed powder is engaged.

* * * * *